US007441348B1

(12) United States Patent
Dawson

(10) Patent No.: US 7,441,348 B1
(45) Date of Patent: Oct. 28, 2008

(54) LEISURE SHOE

(76) Inventor: Andrew Curran Dawson, 448 Harwood Ct., Oxford, MI (US) 48371

( * ) Notice: Subject to any disclaimer, the term of this patent is extended or adjusted under 35 U.S.C. 154(b) by 514 days.

(21) Appl. No.: 10/936,166

(22) Filed: Sep. 8, 2004

(51) Int. Cl.
*A43B 23/26* (2006.01)
*A43B 13/14* (2006.01)

(52) U.S. Cl. ..... 36/54; 36/99; D2/902

(58) Field of Classification Search ..... 36/54, 36/99, 100, 101, 132, 136; D2/902
See application file for complete search history.

(56) References Cited

U.S. PATENT DOCUMENTS

| | | | | |
|---|---|---|---|---|
| 3,601,909 | A | 8/1971 | Amendola | |
| 4,377,913 | A | 3/1983 | Stone | |
| 4,697,362 | A | 10/1987 | Wasserman | |
| 4,805,321 | A | 2/1989 | Tonkel | |
| 5,209,000 | A | 5/1993 | Rowland et al. | |
| 5,239,450 | A | 8/1993 | Wall | |
| 5,313,719 | A | 5/1994 | Koethe | |
| 5,452,269 | A | 9/1995 | Cherdak | |
| 5,457,900 | A | 10/1995 | Roy et al. | |
| 5,459,947 | A | 10/1995 | Lasher | |
| 5,461,188 | A | 10/1995 | Drago et al. | |
| 5,566,477 | A | 10/1996 | Mathias et al. | |
| 5,659,979 | A | 8/1997 | Sileo | |
| 5,661,916 | A | 9/1997 | Huang | |
| 5,673,499 | A * | 10/1997 | Attilieni | 36/54 |
| 5,813,148 | A | 9/1998 | Guerra | |
| 5,845,422 | A | 12/1998 | Valteau, III | |
| 5,894,686 | A | 4/1999 | Parker et al. | |
| 6,000,111 | A | 12/1999 | Deskins et al. | |
| 6,212,797 | B1 | 4/2001 | Merry et al. | |
| 6,278,378 | B1 | 8/2001 | Feiner et al. | |
| 6,321,466 | B1 | 11/2001 | Bordin et al. | |
| 6,397,497 | B1 | 6/2002 | McAtee | |
| 6,408,542 | B1 * | 6/2002 | Shepherd | 36/54 |
| 6,574,887 | B2 | 6/2003 | Jones et al. | |
| 6,578,291 | B2 | 6/2003 | Hirsch et al. | |
| 6,829,847 | B2 | 12/2004 | O'Shea et al. | |
| 6,874,256 | B2 | 4/2005 | Delgatty | |
| 6,898,873 | B2 | 5/2005 | Schenone | |
| 6,964,493 | B1 | 11/2005 | Whitlock | |
| 6,971,192 | B2 * | 12/2005 | Shepherd | 36/54 |
| 7,038,398 | B1 | 5/2006 | Lys et al. | |
| 7,059,070 | B2 | 6/2006 | Omstead et al. | |
| 7,117,616 | B2 | 10/2006 | Hull | |
| D555,333 | S | 11/2007 | Riebesell et al. | |
| 2004/0187184 | A1 | 9/2004 | Rubin et al. | |
| 2004/0255490 | A1 | 12/2004 | Wan et al. | |
| 2006/0112599 | A1 | 6/2006 | Braynock et al. | |
| 2008/0078104 | A1 | 4/2008 | Riebesell | |

FOREIGN PATENT DOCUMENTS

| | | |
|---|---|---|
| WO | WO 00/26890 | 5/2000 |
| WO | WO 2006/042225 | 4/2006 |
| WO | WO 2006/042226 | 4/2006 |
| WO | WO 00/26890 | 5/2006 |

* cited by examiner

*Primary Examiner*—Jila M Mohandesi

(57) ABSTRACT

Described is a shoe (10) including an upper member (12) attached to a bottom sole member (14), the upper member (12) has a opening (16) therein in which is located a foot securing member (18) and a decorative tongue member (24), which decorative tongue member is fixedly attached at a first end (26) to the opening in the upper member, and a distal end (25) of the decorative tongue member which is unattached to the upper member.

20 Claims, 3 Drawing Sheets

LEISURE SHOE

FIELD OF THE INVENTION

The present invention is directed towards a leisure shoe such as a tennis shoe which through the construction of the shoe can add decorative enhancements thereby increasing the marketability of the shoe.

BACKGROUND OF THE INVENTION

In leisure shoes and in particular athletic shoes or sneakers, the ability to have functional as well as decorative footwear is particularly important for successful marketing of such shoes.

U.S. Pat. No. 5,459,947 describes a decorative shoe tongue simulating and lace securing device wherein a decorative attachment is inserted into an ordinary sneaker. The decorative attachment can be readily removed and substituted by use of other attachments such as that shown in FIG. 1 of the patent.

U.S. Pat. No. 4,377,913 describes a double tongue, double locking vamp assembly which utilizes a hook and loop type fastening means, such as that marketed under the trademark Velcro for tightly connecting the tongue with an athletic shoe.

The object, advantages and features of the present invention are directed to utilizing a separate decorative tongue member that is an integral component of the footwear where the footwear also has the usual locking or belting or securing mechanism for engaging a foot.

BRIEF SUMMARY OF THE INVENTION

Figure 1:
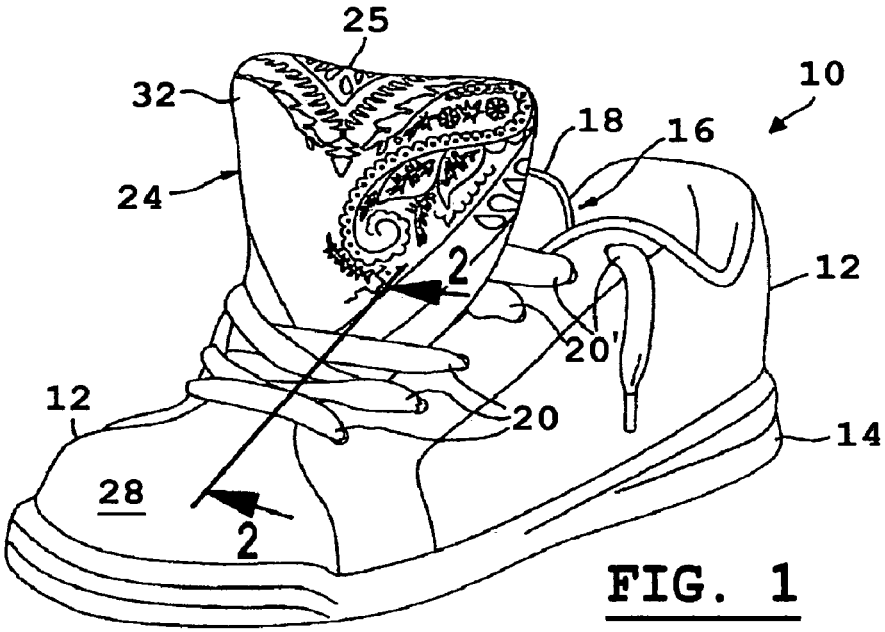
FIG. 1 is a schematic representation of the decorative leisure shoe of the present invention.

Described is a shoe comprising an upper member attached to a bottom sole member, the upper member has a opening therein in which is located a foot securing member and a decorative tongue member, which decorative tongue member is fixedly attached at a first end to the opening in the upper member, and a distal end of the decorative tongue member which is unattached to the upper member.

The present invention is also concerned with a tennis shoe comprising an upper member attached to a bottom sole member, the upper member has a opening therein in which is located a foot securing member and a decorative tongue member, which is fixedly attached at a first end to the opening in the upper member, and a distal end of the decorative tongue member which is unattached to the upper member.

The present invention is also concerned with a leisure shoe comprising an upper member attached to a bottom sole member, the upper member has a opening therein in which is located a foot securing member and a decorative tongue member, which is fixedly attached at a first end to the opening in the upper member, and a distal end of the decorative tongue member which is unattached to the upper member.

The invention is also concerned with a method of manufacturing the shoe of the present invention by attaching an upper member to a bottom sole member, the upper member having an opening therein in which is located a foot securing member and attaching a decorative tongue member to the opening, which decorative tongue member is fixedly attached at a first end to the opening of the upper member and a distal end of the decorative tongue member which is unattached to the upper member.

DETAILED DESCRIPTION OF THE INVENTION

The invention as described herein takes into account the drawings as further included therein. These and other objects, advantages and features of the invention will become apparent to those skilled in the art upon consideration of the following description of the invention.

The intent of the present invention is to utilize the advantages of a shoe which includes an "Expressive-Billboard" feature. The Expressive-Billboard feature of the present invention refers to the decorative tongue member attached to the body of the shoe. The decorative tongue or Expressive-Billboard portion of the shoe is an integral component of the footwear where the footwear also has the usual locking or belting or securing mechanism for engaging a foot. The attached decorative tongue member provides advantages to the individual wearing the leisure shoe.

The first advantage to the leisure shoe is that it provides a secured decorative tongue member for the individual wearing the shoe. This enables the individual wearing the shoe to express their emotions, feelings and desires through the shoes on their feet. If the individual chooses, the decorative tongue member can be changed quickly and easily by removing the tongue-cover (sheath) and replacing it with a different one. The tongue covers (sheath) slip over the decorative tongue member and are secured by an elastomeric tie at the base of the sheath. The second advantage to the decorative tongue member of the shoe is that it is connected near the bottom half of the decorative tongue. This is advantageous because it allows the decorative tongue member to be worn outside of a long pant leg. Furthermore, the individuals pant leg rests between the decorative tongue member and the bottom sole member of the shoe. This allows the decorative tongue member to stand out from the rest of the shoe, further expressing the individuals' desires.

Figure 2:
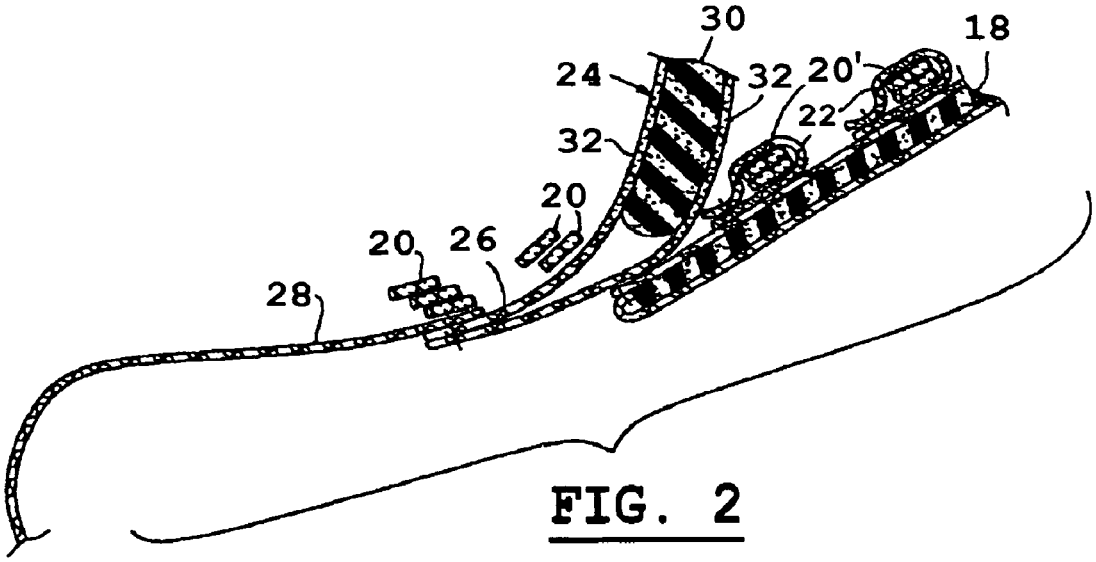
FIG. 2 is a side sectional view taken along lines 2-2 of FIG. 1.

One embodiment of the invention is a leisure shoe 10 having an upper member 12 attached to a bottom sole member 14. The upper member has an opening 16. The foot of a wearer fits within the opening 16. The opening has an elastomeric foot securing member/first tongue 18 which holds the foot in place. The use of an elastomeric member 18 is best shown in FIGS. 1 and 2 with laces 20 securing the tongue 18 in place. The laces fit within eyelets 22.

The illustrated embodiment has a second additional tongue 24 which is decorative in nature and which is generally cantilevered in place namely that is secured at a first end 26 to the front portion 28 of the upper member and an unattached distal end 25. The tongue 24 can take on a variety of compositions such as elastomeric member 30 as shown in FIG. 2. The tongue 24 may be secured in place and fits within a decorative sheath 32. Alternatively, the tongue itself could be solidly and securely attached to the upper member at reference numeral 26 and the decorative sheath slips over the tongue and is held in place by an elastomeric tie at the base of the sheath. The tongue 24 has sufficient rigidity associated with it for it to remain in an upright position with respect to the remainder of the shoe upper and remain close to the upper portion of the shoe satisfactorily covering the opening of the shoe.

As seen in FIG. 1 and FIG. 2, the tongue 24 can be located above or below the laces. The figures illustrate how tongue 24 begins below a portion of the laces 20 at the first end. The figures further show how the unattached distal end 25 extends upward and aback from the first end to extend through and above a remaining portion of the laces 20'. Further from FIG. 1 and FIG. 2, the unattached distal end extends upward and along top of the remaining portion of the laces 20'. The figures illustrate the unattached distal end extending above the remaining portion of the laces, which creates a visible length of space behind the unattached distal end 25 and above the remaining portion of the laces 20'.

The consumers decide how they prefer their tongue 24 to be positioned. The different positions of the tongue provide various advantages to the consumer. For example, as mentioned above, a pant leg of the consumer can rest behind the tongue 24 and above the bottom sole member of the footwear. The illustrated position of the unattached distal end is at least one position that accommodates or rests a pant leg of the consumer. From the illustrated embodiment of FIG. 1 and FIG. 2, the consumer's pant leg can rest in the visible length of space behind the unattached distal end 25 and above the remaining portion the laces 20'. In other words, the consumer's pant leg rests between the unattached distal end 25 and the remaining portion of the laces 20'. As a result, and as mentioned above, the additional tongue 24 stands out from the rest of the shoe.

Figure 6:
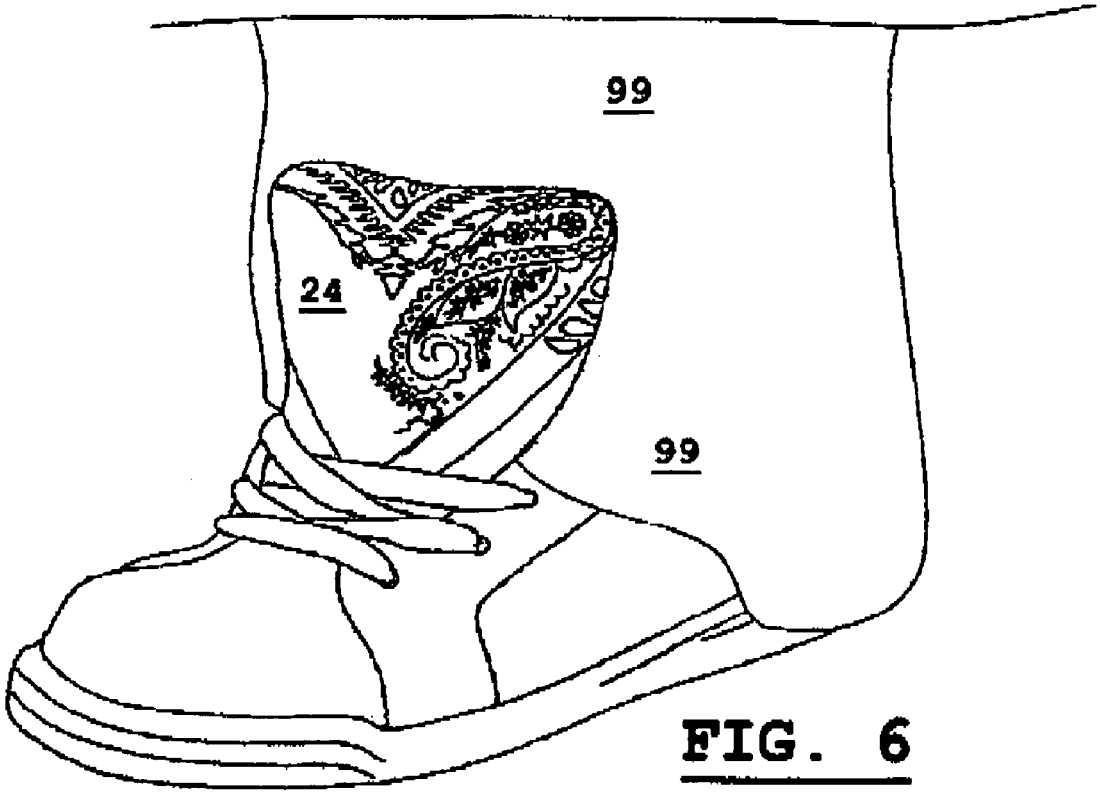
FIG. 6 is a front left view of the leisure shoe including a rested pant leg.

The illustrated embodiment of FIG. 6 clearly shows how a pant leg 99 can rest behind the tongue 24 and above the remainder of the shoe. As a result and as described above, tongue 24 stands out from the rest of the shoe.

FIG. 1 indicates that the laces 20 may likewise secure the tongue 24 in place at the attachment of the tongue to the upper member at 26. As illustrated, a portion of the laces 20 touch an outward most surface of tongue 24 to help secure the tongue during usage of the shoe. Furthermore, from FIG. 1, the remaining portion of the laces 20' are used to secure the foot securing member 18 over the foot of the wearer.

Figure 3:
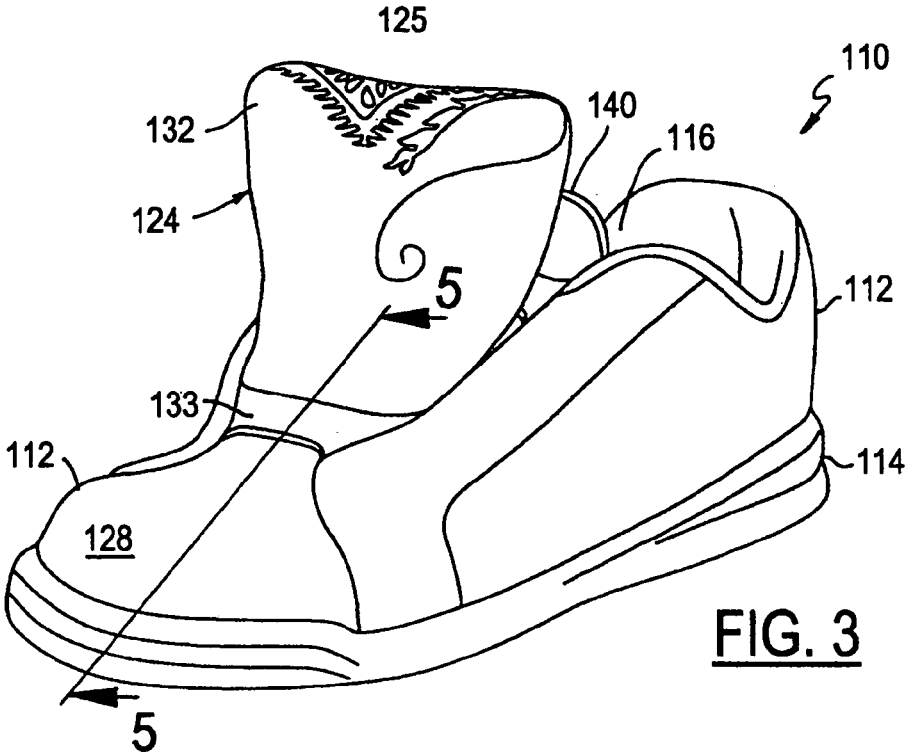
FIG. 3 is an alternative embodiment of the leisure shoe of the present invention.
Figure 4:
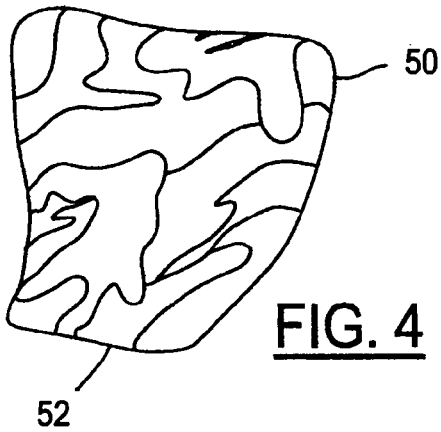
FIG. 4 is a stylistic representation for a substitute cover for the decorative leisure shoe of the present invention.

An alternative to the use of laces to hold the tongue 24 in place is that shown in FIG. 3. For convenience, the applicant has utilized the same reference numerals of FIGS. 1 and 2 in FIG. 3 except that they are now preceded by a "1". The shoe 110 of FIG. 3 has an upper member 112 and a bottom sole member 114 with the additional tongue 124. The tongue 125 is placed on top of the opening 116. An elastomeric foot securing member 140 is used in place of laces 20 and tongue 18 from FIGS. 1 and 2. The tongue 124 is likewise shown as being an elastomeric member 130 fitting within the decorative sheath 132 optionally with a securing band 133. The additional tongue is secured to the upper body by being sewn in place at 126 in the front foot upper portion 128 and has distal end 125, unattached to the opening.

Figure 5:
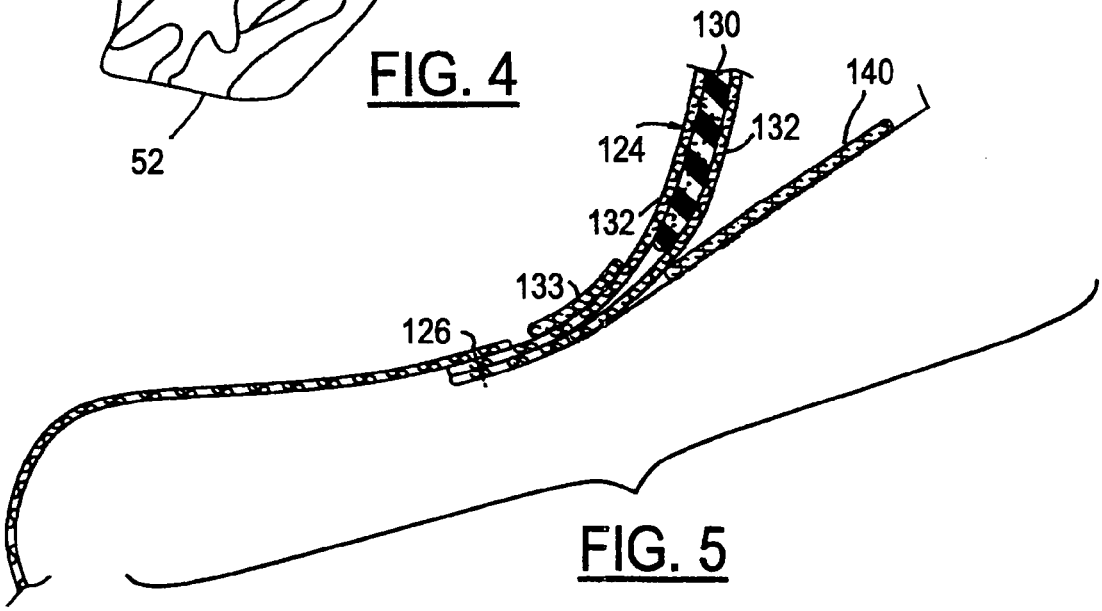
FIG. 5 is a side sectional view of taken along lines 5-5 of FIG. 3.

FIG. 3 further illustrates that the tongue 124 lies above the foot securing member 140. FIG. 3 and FIG. 5 also show how the first end 126 of the tongue 124 is joined to the shoe near the opening and the front portion of the upper member 128. The tongue includes an unattached distal end 125. As seen in the illustrated embodiments, the unattached distal end extends upward and aback from the first end. As mentioned in above paragraphs, the shoe can rest a pant leg of a wearer behind the unattached distal end to help the distal end stand out from the rest of the shoe.

In order to facilitate a more varied decoration for the tongue 24, replaceable sheath 50 can fit over the tongue 24 or 124 to give more variation in styles for the tongue. An elastomeric tie 52 can be sewn in the lower portion of the sheath 50. While FIG. 5 shows that the elastomeric holding member 140 is a rubberized stretch element, any well known elastomeric member for securing a foot could be used in its place.

It should also be appreciated that any variety of closure mechanisms for holding a foot in place can be used in the opening such as belts, buckles and the like.

While the forms of the invention herein disclosed constitute presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention. For example, the decorative tongue can take on many shapes and sizes depending on social and artistic and functional design.

I claim:

1. A shoe comprising an upper member attached to a bottom sole member where the upper member has an opening therein in which is located a foot securing member, and a decorative member, where the decorative member includes a first end and an unattached distal end; where the decorative member further includes a sufficient degree of rigidity; where the foot securing member is located beneath the decorative member and is joined to the shoe proximate to the opening in the upper member; where the decorative member is located above the foot securing member and is only joined to the shoe proximate to the opening and a front portion of the upper member at the first end, where the unattached distal end extends upward and aback from the first end and remains unattached from the upper member, where the decorative member has the sufficient degree of rigidity to remain in an upward and aback position with respect to the remainder of the shoe upper and remain close to the upper portion of the shoe during usage of the shoe; whereby a pant leg of a wearer can rest behind the unattached distal end, during usage of the shoe, to help the decorative member stand out from the rest of the shoe.

2. The shoe of claim 1 wherein the foot securing member is a first tongue and the decorative member is a second tongue.

3. The shoe of claim 1 wherein the decorative member is an integral component of the shoe, whereby the decorative member increases the marketability of the shoe.

4. A shoe comprising an upper member attached to a bottom sole member where the upper member has an opening therein in which is located a first tongue, a second tongue, and a closure mechanism; where the first tongue is located beneath the closure mechanism and beneath the second tongue and is attached to the shoe proximate to the opening in the upper member; where the second tongue includes a first end and an unattached distal end; where the second tongue further includes a sufficient degree of rigidity; where at least a portion of the second tongue is located beneath the closure mechanism and above the first tongue, where the second tongue is attached to the shoe proximate to the opening and a front portion of the upper member at the first end, where the second tongue extends upward and aback from the first end to the unattached distal end; where the second tongue has the sufficient degree of rigidity to remain in an upward and aback position with respect to the remainder of the shoe upper and remain close to the upper portion of the shoe during usage of the shoe; whereby a pant leg of a wearer can rest behind the unattached distal end, during usage of the shoe, to help the second tongue stand out from the rest of the shoe.

5. The shoe of claim 4 wherein a portion of the second tongue is sandwiched between a portion of the first tongue and a portion of the closure mechanism.

6. The shoe of claim 4 wherein the second tongue and the first tongue are joined to the front portion of the upper member.

7. The shoe of claim 4 wherein the closure mechanism is comprised of at least one lace, belt, buckle, or elastic member.

8. The shoe of claim 4 wherein at least a portion of the closure mechanism overlaps a portion of the second tongue and contacts an outward most surface of the second tongue.

9. The shoe of claim 4 wherein the second tongue includes decorative ornamentation.

10. The shoe of claim 4 wherein the first tongue is an elastomeric member capable of stretching to accommodate the insertion of a foot.

11. The shoe of claim 4 wherein the first tongue and second tongue contact one another proximate to the opening and the front portion of the upper member.

12. A shoe comprising an upper member attached to a bottom sole member where the upper member has an opening therein in which is located a foot securing member, a closure mechanism, and a decorative member, where the decorative member includes a first end and an unattached distal end, and where the decorative member further includes a sufficient degree of rigidity; where the foot securing member is located beneath the decorative member and beneath the closure mechanism and is joined to the shoe proximate to the opening in the upper member; where the decorative member is joined to the shoe proximate to the opening and a front portion of the upper member at the first end, where the unattached distal end extends upward and aback from the first end, where the decorative member has the sufficient degree of rigidity to remain in an upward and aback position with respect to the remainder of the shoe upper and remain close to the upper portion of the shoe during usage of the shoe; whereby a pant leg of a wearer can rest behind the unattached distal end, during usage of the shoe, to help the decorative member stand out from the rest of the shoe.

13. The shoe of claim 12 wherein the unattached distal end of the decorative member extends upward and aback from the first end, wherein the distal end extends between portions of the closure mechanism.

14. The shoe of claim 13 wherein the distal end that extends between portions of the closure mechanism, thereby extends along top of a remaining portion of the closure mechanism, thereby creating a length of space sandwiched beneath the distal end and above the remaining portion of the closure mechanism, whereby a pant leg can rest in the length of space.

15. The shoe of claim 14 wherein the pant leg is rested in the length of space and the distal end remains in an upward and aback position with respect to the foot securing member during usage of the shoe.

16. The shoe of claim 12 wherein the foot securing member lies in the opening and is overlapped by a portion of the closure mechanism.

17. The shoe of claim 12 wherein a portion of the closure mechanism overlaps and contacts an outward most surface of the decorative member proximate to the first end.

18. The shoe of claim 17 wherein the portion of the closure mechanism that overlaps the portion of the decorative member, located proximate to the first end, at least helps secure the decorative member, thereby helping the decorative member remain in an upward and aback position with respect to the foot securing member during usage of the shoe.

19. The shoe of claim 12 wherein the closure mechanism is comprised of at least one lace, or belt, or buckle, or elastic member.

20. The shoe of claim 12 wherein the foot securing member is a first tongue and the decorative member is a second tongue.

* * * * *